US009014598B2

(12) United States Patent
Schlumm et al.

(10) Patent No.: US 9,014,598 B2
(45) Date of Patent: Apr. 21, 2015

(54) OIL VAPOR CONDENSATE DRAINAGE USING OLEOPHILIC CHANNELS

(75) Inventors: Doron Schlumm, Kfar Harif (IL); Ami Shiff, Tel Aviv (IL)

(73) Assignee: Hewlett-Packard Indigo B.V., Maastricht (NL)

( * ) Notice: Subject to any disclaimer, the term of this patent is extended or adjusted under 35 U.S.C. 154(b) by 337 days.

(21) Appl. No.: 13/559,582

(22) Filed: Jul. 26, 2012

(65) Prior Publication Data

US 2014/0026771 A1 Jan. 30, 2014

(51) Int. Cl.
*G03G 15/10* (2006.01)
*B41F 31/00* (2006.01)

(52) U.S. Cl.
CPC ..... *B41F 31/00* (2013.01)

(58) Field of Classification Search
CPC ..... B41F 31/00
USPC ..... 399/250
See application file for complete search history.

(56) References Cited

U.S. PATENT DOCUMENTS 6,984,035 B2 1/2006 Anagnostopoulos et al.
7,264,337 B2 9/2007 Lee et al.
7,850,274 B1 12/2010 Chang et al.
2010/0089529 A1 4/2010 Barholm-Hansen et al.
2011/0206903 A1* 8/2011 Mazumder ..... 428/161
2011/0226588 A1 9/2011 Takazawa
2011/0292142 A1 12/2011 LeFevre et al.
2012/0299840 A1* 11/2012 Larson et al. ..... 345/173

OTHER PUBLICATIONS

C-J Chang et al., "Improving mechanical properties and chemical resistance of ink-jet printer color filter by using diblock polymeric dispersants," Journal of Polymer Science: Part B: Polymer Physics, vol. 43, 3337-3353 (year 2005).

* cited by examiner

*Primary Examiner* — Billy Lactaoen

(57) ABSTRACT

Apparatus for draining liquid droplets from a surface is described. The apparatus comprises an array of oleophilic channels substantially interspersed with oleophobic material, wherein a width of an oleophilic channel is arranged to move liquid associated with said droplets along the oleophilic channel by capillary action and wherein a distance between two successive oleophilic channels is less than a critical droplet diameter, the critical droplet diameter corresponding to a droplet that will separate from the surface. The oleophilic channels act to preferentially attract condensed oil and the oleophobic material acts to repel condensed oil such that formation of droplets is restricted by the oleophilic channel. By selecting an appropriate channel width, the size of droplets is prevented from exceeding a critical size, at which the droplets can no longer be held by surface tension to the condensing surface and drip away from the condensing surface.

19 Claims, 6 Drawing Sheets

OIL VAPOR CONDENSATE DRAINAGE USING OLEOPHILIC CHANNELS

BACKGROUND

Digital offset color technology combines ink-on-paper quality with multi-color printing on a wide range of print media such as paper, foil and plastic substrates. Digital printing presses that use digital offset color technology offer cost-effective short-run printing, on-demand service and on-the-fly color switching.

A digital offset printing system works by using digitally controlled lasers to create a latent image in the charged surface of a photo imaging plate (PIP). The lasers are controlled according to digital instructions from a digital image file. Digital instructions typically include one or more of the following parameters: image color, image spacing, image intensity, order of the color layers, etc. Special ink is applied to the partially-charged surface of the PIP, recreating the desired image. The image is then transferred from the PIP to a heated blanket cylinder and from the blanket cylinder to the desired substrate, which is placed into contact with the blanket cylinder by means of an impression cylinder. Because of its role in transferring an image from the PIP to the ultimate substrate, the blanket may sometimes be referred to as an "intermediate transfer member" (ITM).

The ink is fluid on the heated blanket. The ink typically comprises pigment particles incorporated into a resin that is suspended in a carrier liquid. Typically, ink is applied to the blanket at a concentration of 20% (with the remaining 80% comprising carrier liquid). During the printing process, and due at least in part to the heating of the blanket, a large proportion of the carrier liquid is evaporated prior to transfer of the ink to the print medium.

A detailed description of the operation of a typical digital offset printer is described in Hewlett-Packard (HP) White Paper Publication, "Digital Offset Color vs. Xerography and Lithography", for example. Specifically, an example of a digital printer that can be used to create the disclosed printed articles is HP's digital printing press Indigo Press™ 1000, 2000, 4000, or newer, presses, manufactured by and commercially available from Hewlett-Packard Company of Palo Alto, Calif., USA.

DETAILED DESCRIPTION

In the following description, for purposes of explanation, numerous specific details are set forth in order to provide a thorough understanding of the present apparatus and systems. It will be apparent, however, to one skilled in the art that the present apparatus, systems and methods may be practiced without these specific details. Reference in the specification to "an example" or similar language means that a particular feature, structure, or characteristic described in connection with the example is included in at least that one example, but not necessarily in other examples.

Figure 1A:
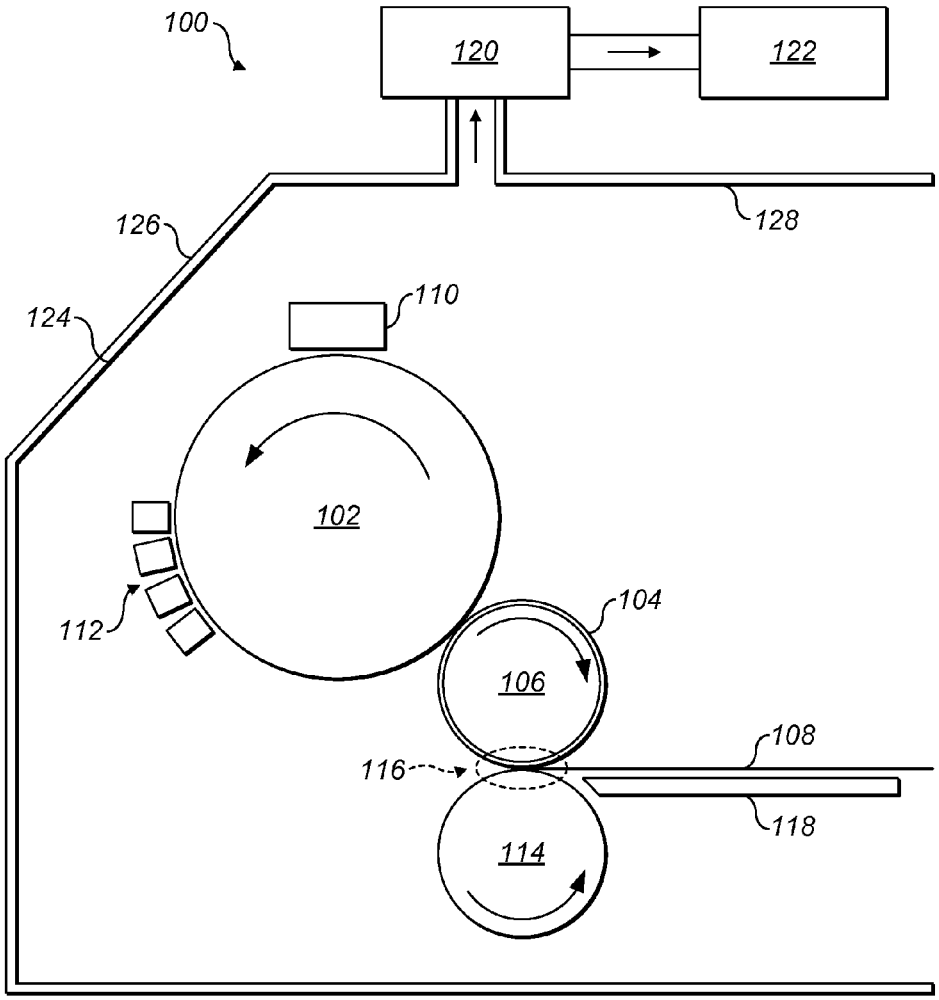
FIG. 1A is a diagram of an illustrative digital offset printing system.

FIG. 1A is a diagram of an illustrative digital offset printing system, which in this example is a digital Liquid Electro Photographic (LEP) printing system in accordance with an embodiment. The term "Liquid Electro Photographic" or "LEP" refers to a process of printing in which a liquid toner is applied onto a surface having a pattern of electrostatic charge, to form a pattern of liquid toner corresponding with the electrostatic charge pattern. This pattern of liquid toner is then transferred to at least one intermediate surface, and then to a print medium. During the operation of a digital LEP system, ink images are formed on the surface of a photo-imaging cylinder. These ink images are transferred to a heated blanket cylinder and then to a print medium. The photo-imaging cylinder continues to rotate, passing through various stations to form the next image.

In the illustrative digital LEP system 100, the desired image is communicated to the printing system 100 in digital form. The desired image may include any combination of text, graphics and images. The desired image is initially formed on a photo-imaging cylinder 102, is then transferred to a blanket 104 on the outside of a blanket cylinder 106, and then transferred to a print medium 108. The blanket 104 may otherwise be referred to as an intermediate transfer member (ITM).

According to one illustrative example, an image is formed on the photo-imaging cylinder 102 by rotating a clean, bare segment of the photo-imaging cylinder 102 under a photo charging unit 110. The photo charging unit 110 includes a charging device such as corona wire, charge roller, or other charging device and a laser imaging portion. A uniform static charge is deposited on the photo-imaging cylinder 102 by the photo charging unit 110. As the photo-imaging cylinder 102 continues to rotate, it passes the laser imaging portion of the photo charging unit 110 that dissipates localized static charge in selected portions of the photo-imaging cylinder 102 to leave an invisible electrostatic charge pattern that represents the image to be printed. Typically, the photo charging unit 110 applies a negative charge to the surface of the photo-imaging cylinder 102. The laser imaging portion of the photo charging unit 110 then locally discharges portions of the photo imaging cylinder 102.

In the described example, ink is transferred onto the photo-imaging cylinder 102 by Binary Ink Developer (BID) units 112. There is one BID unit 112 for each ink color. During printing, the appropriate BID unit 112 is engaged with the photo-imaging cylinder 102. The engaged BID unit presents a uniform film of ink to the photo-imaging cylinder 102. The ink contains electrically-charged pigment particles which are attracted to the opposing electrical fields on the image areas of the photo-imaging cylinder 102. The ink is repelled from the uncharged, non-image areas. The photo-imaging cylinder 102 now has a single color ink image on its surface. In other examples, such as those for black and white (monochromatic) printing, one or more ink developer units may alternatively be provided.

The ink may be a liquid toner ink, such as HP Electroink. In this case pigment particles are incorporated into a resin that is suspended in a carrier liquid, such as Isopar™, a tradename for a range of isoparaffinic fluids, such as those supplied by Exxon Mobil Corporation of Irving, Tex. The ink particles may be electrically charged such that they move when subjected to an electric field. Typically, the ink particles are negatively charged and are therefore repelled from the negatively charged portions of the photo imaging cylinder 102, and are attracted to the discharged portions of the photo imaging cylinder 102. The pigment is incorporated into the resin and the compounded particles are suspended in the carrier liquid. The dimensions of the pigment particles are such that the printed image does not mask the underlying texture of the print medium 108, so that the finish of the print is consistent with the finish of the print medium 108, rather than masking the print medium 108. This enables LEP printing to produce finishes closer in appearance to conventional offset lithography, in which ink is absorbed into the print medium 108.

Returning to the printing process, the photo-imaging cylinder 102 continues to rotate and transfers the ink image to the ITM 104 of the blanket cylinder 106 which is heatable. The blanket cylinder 106 transfers the image from the ITM 104 to a sheet of print media 108 wrapped around an impression cylinder 114. As will be further described below, this process may be repeated for each of the colored ink layers to be included in the final image.

The print medium 108 may be any coated or uncoated paper material suitable for liquid electrophotographic printing. In certain examples, the paper comprises a web formed from cellulosic fibers, having a basis weight of from about 75 gsm to about 350 gsm, and a calliper (i.e. thickness) of from about 4 mils (thousandths of an inch—around 0.1 millimeters) to about 200 mils (around 5 millimeters). In certain examples, the paper includes a surface coating comprising starch, an acrylic acid polymer, and an organic material having an hydrophilic-lipophilic balance value of from about 2 to about 14 such as a polyglycerol ester.

The print medium 108 may be fed on a per sheet basis, or from a roll sometimes referred to as a web substrate. The print medium 108 enters the printing system 100 from one side of an image transfer region 116, shown on the right of FIG. 1A. It then passes over a feed tray 118 and is wrapped onto the impression cylinder 114. As the print medium 108 contacts the ITM 104 of the blanket cylinder 106, the single color ink image is transferred to the print medium 108. The creation, transfer, and cleaning of the photo-imaging cylinder 102 is a continuous process, with the capability to create and transfer hundreds of images per minute with a typical print rate of more than 2 $ms^{-1}$ (i.e. the rate at which the print medium 108 is fed through the LEP system 100).

The image transfer region 116, commonly referred to as "the nip", is a region between the ITM 104 of the blanket cylinder 106 and the impression cylinder 114 where the two cylinders 106, 114 are in close enough proximity to apply a pressure to the back side of the print medium 108 (i.e. the side on which the image is not being formed), which then transmits a pressure to the front side the print medium 108 (i.e. the side on which the image is being formed). The distance between the two cylinders 106, 114 can be adjusted to produce different pressures on the print medium 108 when the print medium 108 passes through the image transfer region 116, or to adjust the applied pressure when a print medium 108 of a different thickness is few through the image transfer region 116. In certain examples, to form a color image, the different colors of ink are accumulated on the ITM 104 before passing the print medium 108 through the image transfer region 116. In these cases a blanket cylinder 106 will come into contact with a print medium 108 once.

In certain other examples, to form a single color image (such as a black and white image), one pass of the print medium 108 between the impression cylinder 114 and the blanket cylinder 106 completes the desired image For a color image, the print medium 108 is retained on the impression cylinder 114 and makes multiple contacts with the blanket cylinder 106 as it passes through the image transfer region 116. At each contact, an additional color plane may be placed on the print medium 108.

For example, to generate a four color image, the photo charging unit 110 forms a second pattern on the photo-imaging cylinder 102, which receives the second ink color from a second BID unit 112. In the manner described above, this second ink pattern is transferred to the ITM 104 and impressed onto the print medium 108 as it continues to rotate with the impression cylinder 114. This continues until the desired image with all four color planes is formed on the print medium 108. Following the complete formation of the desired image on the print medium 108, the print medium 108 can exit the machine or be duplexed to create a second image on the opposite surface of the print medium 108. Because the printing system 100 is digital, the operator can change the image being printed at any time and without manual reconfiguration.

A cleaning station (not shown) may be located near the photo-imaging cylinder 102. A cleaning station is arranged to clean residual ink from the photo-imaging cylinder 102 after the image has transferred to the ITM 104. The cleaning station also cools the photo-imaging cylinder 102 to a desired temperature (typically ~28° C.).

Typically, ink is applied to the ITM 104 at a concentration of 20% (with the remaining 80% comprising a carrier liquid). During the printing process, and due at least in part to the heating of the ITM 104, a large proportion of the carrier liquid is evaporated prior to transfer of the ink to the print medium 108. The evaporated carrier liquid is at least partly collected from the areas surrounding the ITM 104 by a suction device 120; it is then carried to a 'capture and control' unit 122 that comprises a heat exchanger where it condenses. During this process, moisture (water vapor) from the air also condenses. The capture and control unit 122 is arranged to separate the carrier liquid from the condensed water (since the carrier liquid is significantly lighter than water), and store the separated carrier liquid in a reservoir (not shown).

In certain examples, a recycling system (not shown) then recycles the collected and liquefied carrier liquid for use in subsequent print operations. The recycling system may be part of the capture and control unit 122, or may be a separate unit.

The components of the printing device 100 described above are typically contained within a hood 124 that protects the components of the printing device 100 from foreign bodies that might otherwise become entangled in the workings of the printing device 100 when in operation. The hood 124 also protects users of the printing device 100 from injuries that might otherwise be caused by moving parts or vapors released during the printing process. It also protects the print medium from contaminants that might otherwise contaminate the print medium 108 or any of the components involved in the transfer of ink.

The hood 124 comprises an outer surface 126 and an inner surface 128. During the printing process the inner surface 128 may be exposed to vapors released during the printing operation. Typically, the inner surface 128 is significantly cooler, i.e. has a lower temperature, than the heated blanket of the ITM 104. Accordingly, vapors derived from the evaporation of the carrier liquid from the heated blanket have a temperature that is higher than the inner surface 128. Consequently, under certain conditions, some of the vapor that is intended to be removed from the areas surrounding the ITM 104 and collected by the capture and control unit 122 condense onto the inner surface 128 of the hood 124 (and indeed other 'cold' surfaces) before it is removed and collected. This is particularly the case for vapors that are almost saturated.

In such circumstances, if the printing process continues such that condensed vapor is able to build up, droplets of vapor condensate form on the inner surface 128 of the hood 124. Provided the droplets remain below a critical mass or size, they may remain stationary and in contact with the inner surface 128. However, if a droplet is allowed to exceed the critical mass, one or more forces acting on the droplet cause it to no longer adhere to the inner surface 128. This then results in droplets dripping from the inner surface and, in turn, contamination of the print medium 108 and/or portions of the printing device 100 involved in the transfer of ink to the print medium 108. For example, if a droplet falls on the heated blanket it may change the ink to oil ratio of any toner deposited on said blanket. This in turn can change the transferability of the image to the substrate, i.e. can make the transfer of an image to a print medium difficult. Additionally, on a next drum-turn any droplet forming an image on the heated blanket following the transfer of an image to a print medium will transfer to the next substrate and cause a print defect. As can be seen by these examples, contamination leads to a reduction in print quality.

In certain printing systems, a cleaning station is located near the hood 124. This results in vapor escaping from the suction device 120 and condensing on a cleaning tray of the cleaning station, due to the cleaning station having a low operating temperature. The condensate is then able to drip from the cleaning tray onto components involved in a printing operation.

In accordance with examples described herein, there is provided apparatus for draining condensate from a condensing surface. This apparatus may be used in the printing system described above or in other systems where condensate formed from oil vapor is problematic. Certain examples comprise an array of channels having a first wetting property substantially interspersed with at least a material having a second wetting property, the two wetting properties being different. In certain examples, the first wetting property comprises an oleophilic, or oil-attracting, property and the second wetting property comprises an oleophobic, or oil-repelling, material. A width of one or more of the oleophilic channels is configured to move condensate along the oleophilic channel by capillary action. In this case, capillary action refers to an ability of a liquid to flow without the assistance of, and in certain situations in opposition to, external forces such as gravity. This occurs in structures that are sufficiently small such that a combination of one or more of surface tension, due in turn to cohesion within a liquid, and one or more adhesive forces between the liquid and the structure act to move or propel the liquid along the structure. Furthermore, the greater the difference in first and second wetting properties, the greater the flow rate of the liquid. In the apparatus of certain examples, a distance between two successive oleophilic channels is less than a critical droplet diameter. The critical droplet diameter is determined by a droplet of condensate that will separate from the condensing surface. This depends on factors such as the angle of the condensing surface and/or the material properties of the condensate.

As described herein 'wetting' refers to a property associated with a surface energy of a surface such that, where there is a difference in wetting properties in a first and second surface, liquid will tend to flow from one of the surfaces to the other, if the liquid is in contact with both the first and second surfaces. The greater the difference in wetting properties the higher the flow rate (assuming a viscosity property is the same).

Apparatus according to examples described herein has a benefit of facilitating the drainage of condensate. For example, they facilitate the drainage of condensate from vapor produced from evaporating carrier liquid during a printing operation. As such the apparatus may form part of a drainage device, wherein the drainage device is arranged to drain liquid droplets of condensate formed from oil vapor released from an ink vehicle. The ink vehicle may be an oil-based carrier liquid, such as those used in LEP printing systems. The apparatus, in the form of said drainage device, is applicable to printing devices where condensate derived from oil-based carrier liquid is problematic. As well as LEP printing systems the apparatus may also be used in ink-jet systems. An apparatus as described in examples herein can enable a printing system or device to print at higher vapor concentrations, and therefore at higher print rates, without suffering from a reduction in print quality, for example reductions caused by dripping liquids.

In certain examples, providing oil-repelling channels along which the condensate can drain prevents the formation of droplets that exceed a critical mass such that they may become detached from a condensing surface. The condensate can thus be directed to one or more of the suction device 120 and the capture and control unit 122 using a passive, i.e. unpowered, structure. This alleviates the need to heat surfaces on which condensate would otherwise form, or to increase the air flow provided by a ventilation or suction device, in order to prevent condensation of vapor. This in turn reduces consumption of electrical energy by removing the need to heat the condensing surface or increase the rate of heating of the blanket of the ITM due to excessive cooling by an increased airflow.

Figure 1B:
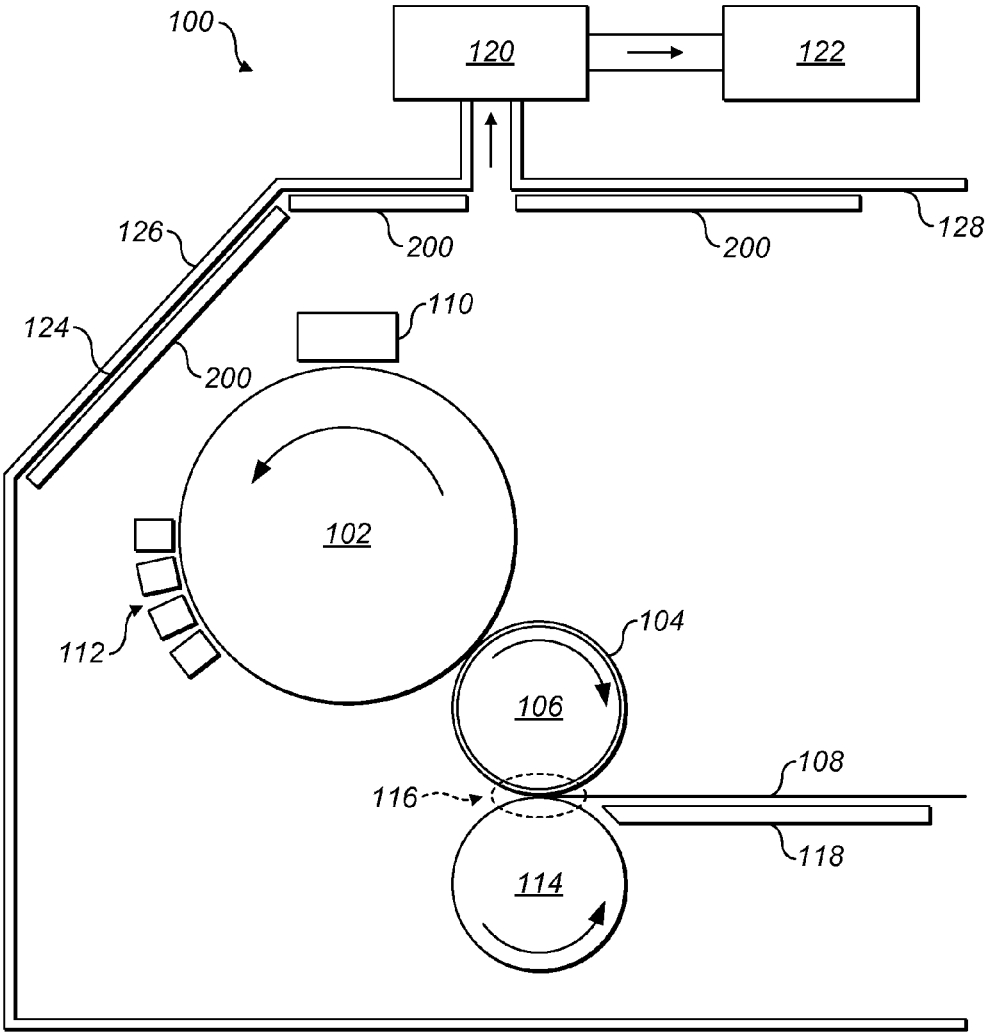
FIG. 1B is a diagram of an illustrative digital offset printing system in accordance with an example.

Certain examples will now be described in more detail, in the context of the printing system of FIG. 1A; however, the use of the printing system of FIG. 1A is for example only and other example may be implemented in other systems, including other printing systems. In the example shown in FIG. 1B, the printing device 100 comprises a condensing surface 200 located on the inner surface 128. The condensing surface 200 may be a surface of a plate or other structure fixed to the inner surface 128, as shown in FIG. 1B, or may be fabricated directly onto the inner surface 128. In certain implementations, the condensing surface 200 may be located on or near portions of the inner surface 128 directly above a path of the print medium 108 and/or components of the printing device 100 involved in the transfer of ink. This then minimizes the risk of droplets of condensate falling onto the print medium 108 and/or said components and as such reducing the quality of a printed image. In other implementations, the condensing surface 200 may be located at other portions of the printing device 100 where vapor condensate may form, such as on a cooled tray of the cleaning station.

Figure 2A:
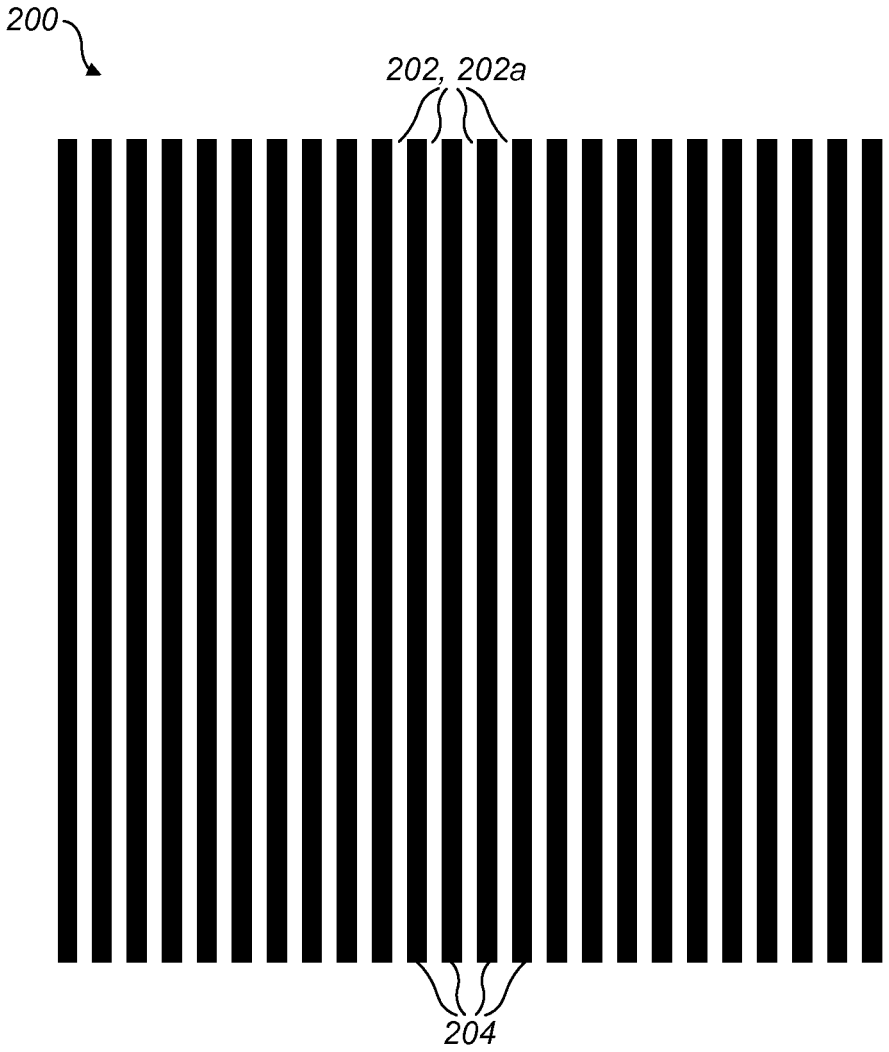
FIG. 2A is a diagram of a condensing surface in accordance with an example.

FIG. 2A shows an arrangement of at least a portion of condensing surface 200 according to an example. In FIG. 2A, the condensing surface 200 comprises oleophilic portions 202 and oleophobic portions 204. In FIG. 2A the oleophilic portions 202 comprise a plurality of parallel, elongate channels interspersed with said oleophobic portions 204. The channels comprising the oleophilic portions 202 are narrow in that they have a width value considerable less than a length value. Condensed oil vapor will tend to be attracted to the oleophilic portions 202, and will tend to be repelled from the oleophobic portions 204.

In certain examples, such as the example shown in FIG. 2A, the condensing surface 200, comprises alternating strips of oleophilic material and oleophobic material, so as to form oleophilic channels 202*a* substantially interspersed with oleophobic material. In FIG. 2A, the alternating strips have a respective first and second width value, wherein the two values are approximately equal. However, the first and second width value may be different. As droplets forming on the condensation surface tend to be attracted to the oleophilic portions 202 and repelled from the oleophobic portions 204 they will preferentially form in the oleophilic channels 202*a*. A width of the oleophilic channels 202*a* is selected such that a particular oleophilic channel 202*a* in which a droplet forms exerts a capillary force on said droplet.

A width of an oleophilic channel 202*a* is selected such that capillary action encourages flow of vapor condensate. In certain examples, an oleophilic channel 202*a* has one or more sidewalls. For example, an oleophobic material may have a height on the condensing surface 200 and/or the oleophilic channels may have a depth on the condensing surface 200. In one case, an oleophobic material may be deposited in strips on the condensing surface 200 and/or the oleophilic channels may be etched into the condensing surface 200. In these cases, one or more of the sidewalls of an oleophilic channel 202*a* may also have oleophilic properties to aid drawing vapor condensate into the oleophilic channels 202*a*. An oleophilic coating may also be applied to the oleophobic sidewall of the oleophobic portion 204, in order to improve capillarity. In cases where one or more sidewalls of the oleophilic channels 202*a* are oleophilic, the maximum width of the oleophilic channels 202*a* is increased, and therefore the maximum flow rate at which vapor condensate can be drained is increased.

In cases where Isopar™ concentrate is to be drained, a suitable minimum width of an oleophilic channel 202*a* may be 100 μm. However, this value will depend on the implementation as described above.

The capillary force causes droplets that come into contact with an oleophilic channel 202*a*, for example those that form in the channel or that are directed to the channel from an oleophobic portion, to be drained by capillary action along the channel 202*a*. In an implementation such as that shown in FIG. 1B, the oleophilic channels 202*a* are orientated such that droplets of liquid drain towards a collection area, such as suction device 120, or an area away from a print medium 108 or print components such that droplets can fall from said area without impacting on print quality.

In certain examples, the oleophobic material, which may form an oleophobic layer, has a minimum height. The minimum height is set to minimize and/or eliminate the cohesive forces between oil portions on the oleophobic layer and oil portions within one or more oleophilic channels 202*a*. This has an effect of preventing liquid that forms and/or collects on the oleophobic portions 204 from drawing liquid from the oleophilic channels 202*a*. In certain implementations a minimum height of 1 μm achieves this effect, although this value may differ for different circumstances and implementations. In certain cases, a minimum height is selected to be less than the width of the oleophilic channels.

The capillary force exerted on droplets of condensate enables the condensing surface 200 to act as a drainage device. The condensing surface 200 may be orientated such that the oleophilic channels 202*a* are horizontal. In this case, no additional horizontal component of gravitational force is acting on the droplets to move them in a horizontal direction but they are still drained through the capillary force.

In use, in a location comprising oil vapor, vapor condenses on the condensing surface 200. As such it begins to form one or more droplets on the condensing surface 200. Over time, as more vapor condenses, one or more droplets increase in size (and mass), such that the diameter of the droplet increases. In certain examples, the distance between two successive oleophilic channels 202*a* is arranged to be less than a diameter that would result in a droplet falling from the condensation surface 200. For example, depending on at least the orientation of the condensation surface 200 and the material properties of the condensate, there will exist a critical droplet diameter that will cause a droplet to detach from the condensation surface 200 under the force of its own weight. The critical droplet diameter may be determined experimentally and/or theoretically for a particular implementation. In certain implementations, the critical droplet diameter is in the order of a few mm. However, this may vary depending on the implementation; for example it may be less in the vicinity of an air flow. The critical droplet diameter will relate to an associated critical mass. In certain cases the critical mass depends on an experienced surface tension and a wetting angle between an oil droplet and the condensing surface 200. By spacing successive oleophilic channels 202*a* to be less than a critical diameter, in some cases by half the critical diameter, this prevents the formation of droplets meeting or exceeding the critical mass that do not come into contact with at least a part of an oleophilic channel 202*a*.

In certain examples, the width of the oleophobic portions 204 are less than half the diameter of a droplet with a critical mass, formed from vapor condensate.

A maximum width of the oleophobic portion 204, or the maximum distance between the oleophilic channels 202*a*, may depend on the properties of liquid to be drained and on the surface tension of the oleophobic material that the oleophobic portion 204 is made from.

In certain implementations where a critical droplet diameter is in the range of 2 mm, a width of the oleophobic portion 204 is less than 500 μm, i.e. a distance between two oleophilic channels 202*a* is less than 500 μm. A distance between oleophilic channels 202*a* may also depend on one or more properties of the liquid to be drained and/or a surface tension property of an oleophilic material used to construct the oleophilic channels. In any case, the width of the oleophobic portion, i.e. a distance between successive oleophilic channels, is less than a droplet diameter that results in a droplet falling from the condensing surface due to gravity forces acting against the surface tension forces at the drop edges, i.e. is less than the critical droplet diameter. In the examples described herein that use a carrier liquid or ink vehicle that comprises an isoparaffinic fluid (e.g. Isopar™ grade L), the droplets have a surface tension value of 25 mN/m at 25° C., and so this may be used to determine a width of oleophobic material.

In certain examples, the inner surface 128 of the hood 124 may be arranged to be angled with respect to the horizontal at locations over the print medium 108 and components of the printing device 100 involved in the transfer of ink. In such examples, drainage of condensed vapor by a condensing surface 200 fixed to or located on the inner surface 128 at those locations is assisted by an additional horizontal component of gravitational force, i.e. in addition to capillarity.

Figure 2B:
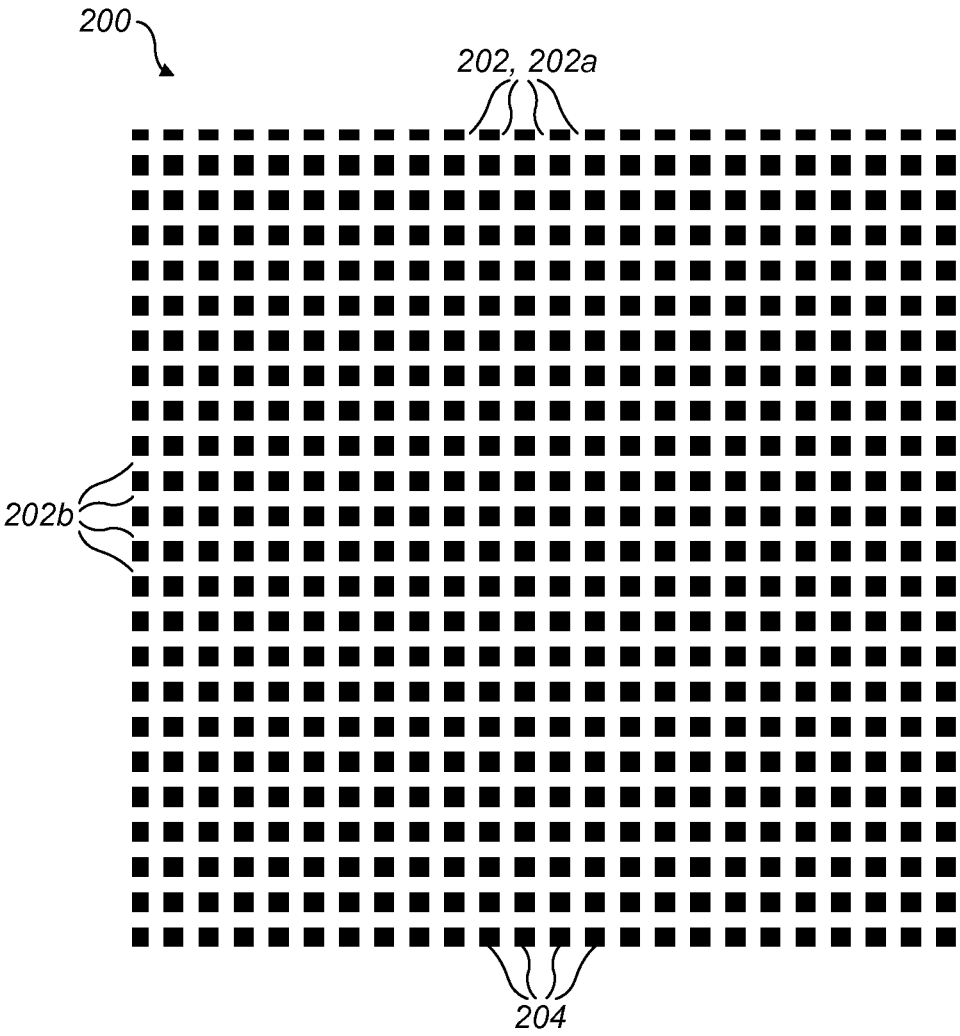
FIG. 2B is a diagram of a condensing surface in accordance with an example.

FIG. 2B shows an alternative example of a condensing surface 200. In this example, the oleophilic portions 202 form a grid such that the drainage channels 202*a* are connected by oleophilic cross channels 202*b*. The oleophilic cross channels 202*b*, enable vapor condensate from one oleophilic channel 202*a*, to cross the oleophobic portions 204. This enables oil condensate in one oleophilic channel 202*a* to migrate to an adjacent channel 202*a*, which in turn enables a more even distribution of vapor condensate on the condensing surface 200, thereby reducing the chance of any given channel 202*a* becoming overloaded with vapor condensate.

Figure 2C:
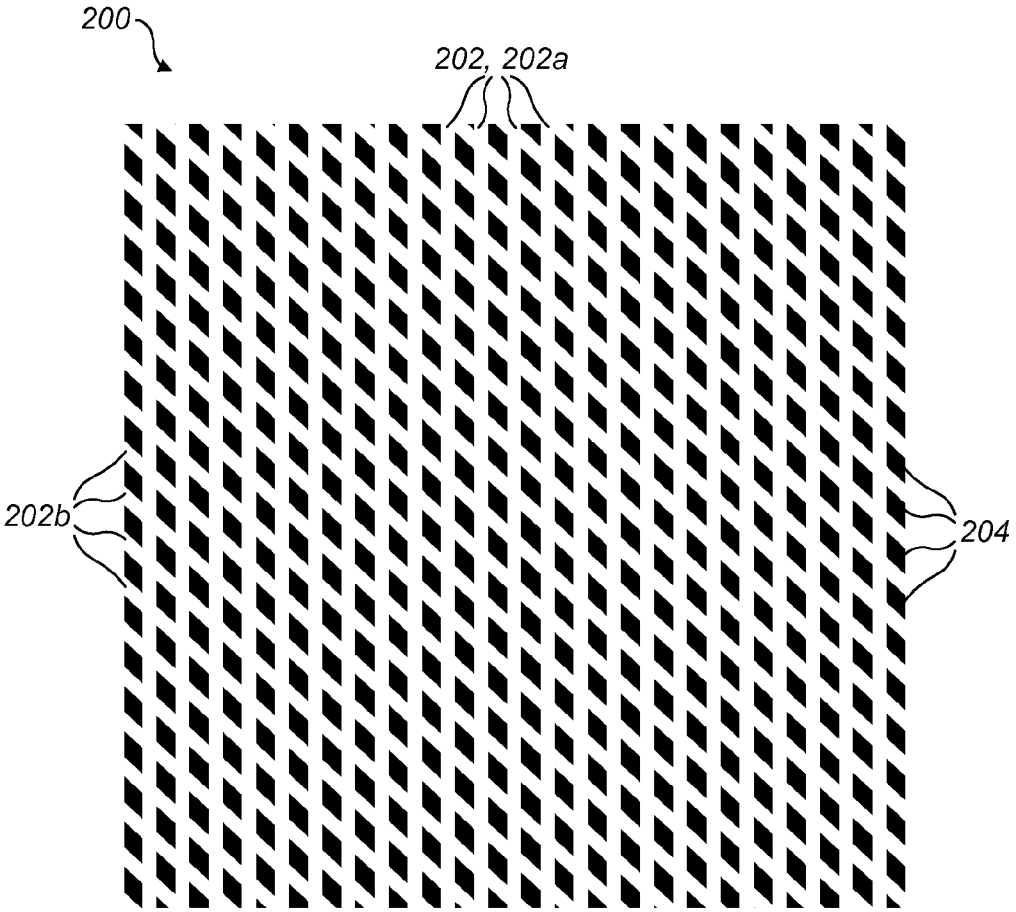
FIG. 2C is a diagram of a condensing surface in accordance with an example.

FIG. 2C shows a further example of a condensing surface 200, in which the oleophilic cross channels 202*b* are not perpendicular to the oleophilic channels 202*a*. In certain circumstances, for example where the condensing surface is not horizontal, this enables drainage of vapor condensate between oleophilic channels 202*a* to be assisted by an additional horizontal component of gravitational force.

Figure 3A:
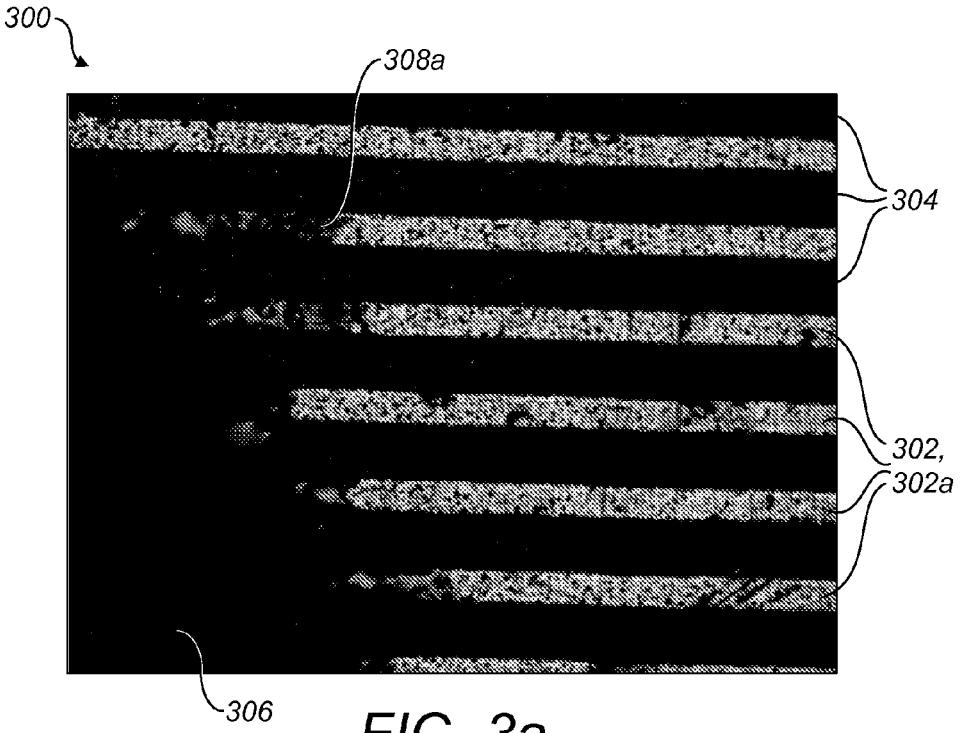
FIG. 3A is an image showing the effect of a condensing surface in accordance with an example.
Figure 3B:
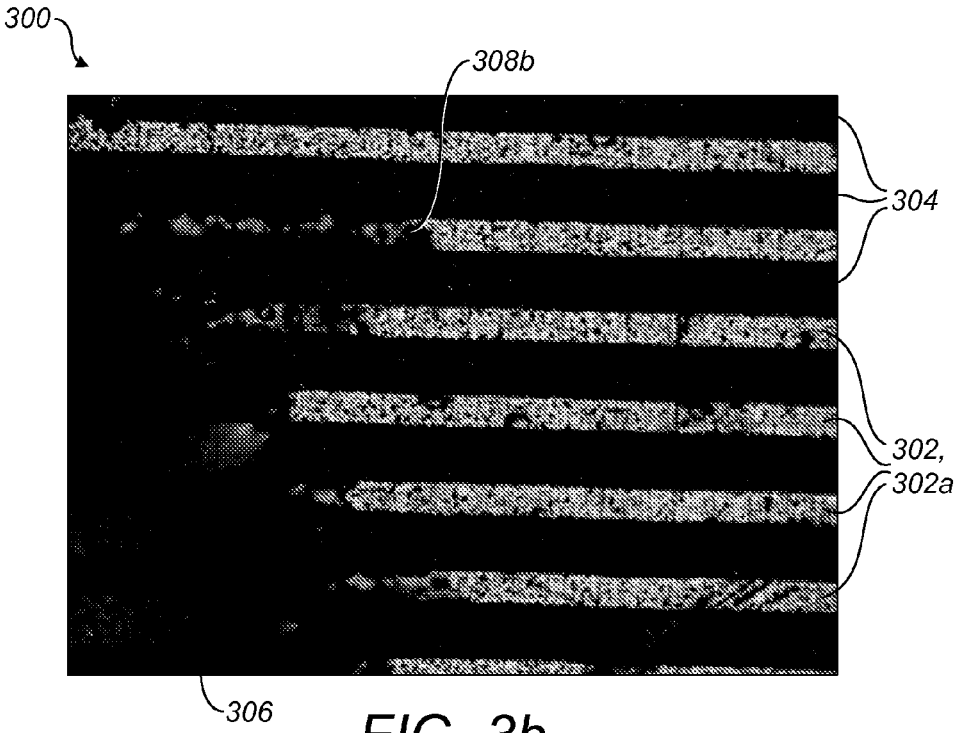
FIG. 3B is an image showing the effect of a condensing surface in accordance with an example.

FIGS. 3A and 3B show the effect of a condensing surface 300 according to an example comprising oleophilic portions 302 forming oleophilic channels 302*a* and oleophobic portions 304.

In the examples shown in FIGS. 3A and 3B, the condensing surface 300 is an offset plate, as used in conventional offset printing. The offset plate may be aluminum positive, wherein aluminum provides the oleophobic portions 304. A negative plate may also alternatively be used. A surface of the plate may be treated to render it porous.

To create oleophilic channels 302*a*, the offset plate is coated with a photosensitive polymer material. The oleophilic channels 302*a* may then be opened, i.e. created, by a photolithographic method in which cross-links of the polymer material in portions of the photosensitive material are broken when exposed to UV light, causing those portions to become soluble to a developer solution (in a so called 'positive' process). When the photosensitive material is then exposed to the developer solution, the exposed portions of the photosensitive material are washed away, and the unexposed portions remain. Exposed metal portions of the condensing surface 300 are oleophobic, and the portions of photosensitive material are oleophilic. In other cases an oleophobic material may be deposited on top of the unexposed portions that form the oleophilic channels.

If a so-called 'negative' photosensitive material is used exposure to UV light has the effect of forming cross-links in the photosensitive material so as to make it insoluble to the developer solution and the resulting pattern that is produced on the condensing surface 300 is reversed.

In certain embodiments, other material can be used to form the plate. For example, the plate may be made from other metals such as zinc, or from a combination of metals, or from paper or plastics materials such as polyester.

In certain embodiments, the photosensitive material is one or more of a thin film coating, FDTS (i.e. 1H,1H,2H,2H-perfluorodecyltrichlorosilane) and Parylene.

In FIG. 3A, a test oil droplet 306 has been placed on the condensing surface 300. The test oil droplet 306 is preferentially attracted to oleophilic channels 302*a* of the condensing surface 300 (seen as brighter portions of the image) and is repelled by oleophobic portions 304 of the condensing surface 300 (seen as darker portions of the image).

FIGS. 3A and 3B also shows the effect of a capillary force exerted by an appropriately dimensioned oleophilic channel 302*a*. FIG. 3A shows that the oil has travelled a first distance 308*a* after a first time, and FIG. 3B shows that the oil has travelled a second, further, distance 308*b* after a second, longer, time. In FIG. 3B the direction of movement is from left to right.

For the purposes of demonstration, the test oil droplet 306 applied to the condensing surface 300 shown in FIGS. 3A and 3B was applied as a large liquid droplet with a diameter much larger than the width of the oleophobic portion 304. However, it will be understood that in use as a condensing surface 200, 300, droplets of vapor condensate are much smaller than shown, and are channeled until they are fully drained into the oleophilic channels 202*a*, 302*a*.

Returning to the printing device of FIG. 1B, in certain examples, the condensing surface 200 may be arranged to drain oil condensate to a reservoir. The reservoir may be the same reservoir described in relation to FIG. 1A. In this case, condensate is drained to a collection reservoir that used by the capture and control unit 122 to stored liquefied and separated carrier liquid vapor. In other cases, a dedicated reservoir may be supplied for use by the condensing surface 200. In any event, the condensate stored in the reservoir may be recycled by the recycling system in subsequent printing operations.

In certain examples, the oleophilic channels 202*a* are connected to a drainage path which connects the oleophilic channels 202*a* to the reservoir. In certain examples, the reservoir is located at a lower height than the surface of the condensing surface 200, i.e. there is a vertical distance from the condensing surface 200 to the reservoir. This may be the case for the other examples as well. As long as a drainage point is lower than the condensing surface, there is no need for a continuous down-slope towards a drainage point, e.g. a channel path may be indirect.

In such examples, once the oleophilic channels 202*a* and the drainage path are filled with vapor condensate, drainage of the vapor condensate to the reservoir may be assisted by siphonic action, regardless of the orientation of the condensing surface 200.

In certain examples, prior to use, a condensing surface may be primed (for example, by condensing oil vapor onto the condensing surface 200 and/or by applying fluid using a wiper) to fill up the oleophilic channels 202*a* and thereby reduce the time in use before vapor condensate is drained at the maximum rate. These 'priming' techniques allow drainage to start immediately.

Although in the examples described above reference is made to liquid electro-photographic printing devices, it will be understood that other printing devices in which vapor is released during the print operation may also include a condensing surface as described herein. Likewise, it will also be understood that the apparatus described above may be applied in non-printing systems where condensate from an oil vapor is problematic.

The preceding description has been presented only to illustrate and describe examples of the principles described. This description is not intended to be exhaustive or to limit these principles to any precise form disclosed. Many modifications and variations are possible in light of the above teaching.

What is claimed is:

1. Apparatus comprising:

a condensing surface on which condensate occurs;

an array of oleophilic channels substantially interspersed with oleophobic material, wherein a width of an oleophilic channel is arranged to drain the condensate formed from oil vapor along the oleophilic channel by capillary action and wherein a distance between two successive oleophilic channels is less than a critical droplet diameter, the critical droplet diameter corresponding to a droplet of condensate that will separate from the condensing surface; and a removal mechanism to remove the condensate drained by the oleophilic channels.

2. Apparatus according to claim 1, wherein the condensing surface is orientated such that droplets formed on the surface experience a gravitational force directed away from the condensing surface.

3. Apparatus according to claim 1, wherein the channels comprise sidewalls, the sidewalls also being oleophilic.

4. Apparatus according to claim 1, wherein a first surface of the oleophilic channel is separated from a substantially parallel surface of the oleophobic material by a predetermined distance.

5. Apparatus according to claim 1, wherein the condensing surface comprises a substrate and the array of oleophilic channels are arranged on said substrate.

6. Apparatus according to claim 5, wherein the substrate comprises a metallic plate.

7. Apparatus according to claim 1, comprising an oleophilic cross channel linking at least one of the array of oleophilic channels with an adjacent oleophilic channel.

8. Apparatus according to claim 7, wherein the oleophilic cross channel is perpendicular to the array of oleophilic channels.

9. A drainage device for use in a printing device comprising:

an array of oleophilic channels substantially interspersed with oleophobic material, wherein a width of an oleophilic channel is arranged to drain condensate formed from oil vapor released from an ink vehicle along the oleophilic channel by capillary action and wherein a distance between two successive oleophilic channels is less than a critical droplet diameter, the critical droplet diameter corresponding to a droplet of condensate that will separate from the condensing surface.

10. A liquid electro-photographic printing device comprising:

an intermediate transfer member, on which a liquid toner comprising ink particles and an imaging oil at least partially dries, and a drainage device comprising:

an array of oleophilic channels substantially interspersed with oleophobic material, wherein a width of an oleophilic channel is arranged to drain condensate formed from oil vapor released from the liquid toner as it dries along the oleophilic channel by capillary action and wherein a distance between two successive oleophilic channels is less than a critical droplet diameter, the critical droplet diameter corresponding to a droplet of condensate that will separate from the condensing surface.

11. A liquid electro-photographic printing device according to claim 10, wherein the drainage device is mounted upon a surface within the liquid electro-photographic printing device.

12. A liquid electro-photographic printing device according to claim 10, wherein the drainage device is mounted upon a surface within the liquid electro-photographic printing device, at a substantially non-horizontal angle.

13. A liquid electro-photographic printing device according to claim 10 wherein the drainage device is arranged to drain liquid droplets into a reservoir.

14. A liquid electro-photographic printing device according to claim 11, arranged to recycle drained liquid for use in subsequent print operations.

15. A liquid electro-photographic printing device according to claim 11, wherein at least a portion of the condensing surface is located at a height greater than a height of the reservoir.

16. A method comprising:

providing an apparatus including a condensing surface on which condensate occurs and including a removal mechanism;

determining a width of one or more oleophilic channels such that the condensate formed from oil vapor is drained along said oleophilic channels by capillary action for removal by the removal mechanism;

determining a critical droplet diameter corresponding to a droplet of condensate that will separate from the condensing surface; and providing an array of oleophilic channels of the apparatus on the condensing surface substantially interspersed with oleophobic material, wherein a width of the oleophilic channels is set based on the determined width and a distance between two successive oleophilic channels is set to be less than the critical droplet diameter.

17. A method according to claim 16, comprising:

providing a layer of oleophilic material;

depositing a layer of oleophobic material onto the layer of oleophilic material; and etching portions of the layer of oleophobic material and corresponding portions of the layer of oleophilic material, wherein the width of the etched portions substantially corresponds with the determined width of the one or more oleophilic channels.

18. A method according to claim 16, comprising:

providing a layer of oleophilic material;

depositing strips of oleophobic material onto the layer of oleophilic material, wherein a separation of the strips of oleophilic material substantially corresponds with the determined width of the one or more oleophilic channels; and etching portions of the layer of oleophilic material located between the strips of oleophobic material such that the width of the etched portions substantially corresponds with the determined width of the one or more oleophilic channels.

19. A method according to claim 16, wherein the array of oleophilic channels are provided on a substrate.

* * * * *